US007407060B2

(12) United States Patent
Swartz et al.

(10) Patent No.: US 7,407,060 B2
(45) Date of Patent: Aug. 5, 2008

(54) WALL-MOUNTED SHELVING SYSTEM

(75) Inventors: Robert K. Swartz, Dallas, PA (US); Kenton J. Droppers, West End, NC (US); Robert J. Welch, Dallas, PA (US); James J. Janick, Hanover Township, PA (US); Jeffrey C. Olson, Dallas, PA (US); Robert R. Steele, Sweet Valley, PA (US)

(73) Assignee: Metro Industries, Inc., Reno, NV (US)

( * ) Notice: Subject to any disclaimer, the term of this patent is extended or adjusted under 35 U.S.C. 154(b) by 4 days.

(21) Appl. No.: 11/266,057

(22) Filed: Nov. 2, 2005

(65) Prior Publication Data

US 2006/0102817 A1 May 18, 2006

Related U.S. Application Data

(60) Provisional application No. 60/625,407, filed on Nov. 3, 2004.

(51) Int. Cl.
*A47F 5/08* (2006.01)
*A47B 47/00* (2006.01)

(52) U.S. Cl. ..... 211/94.01; 211/190

(58) Field of Classification Search ..... 211/94.01, 211/189, 162, 90.01–90.04, 106.01, 86.01, 211/134, 187, 103, 190, 207; 247/235, 244, 247/250, 539, 535, 230.2, 229.21; 248/235, 248/244, 250, 539, 535, 230.2, 229.21; 108/106–108, 108/144.11, 147.11–147.18
See application file for complete search history.

(56) References Cited

U.S. PATENT DOCUMENTS 3,245,495 A * 4/1966 Wells, Jr. ..... 182/152
3,424,111 A 1/1969 Maslow ..... 108/144
3,523,508 A 8/1970 Maslow ..... 108/144
3,757,705 A 9/1973 Maslow ..... 108/144
4,209,098 A * 6/1980 Adams ..... 211/70.8
4,595,165 A * 6/1986 Klingensmith et al. ..... 248/539
4,869,378 A * 9/1989 Miller ..... 211/94.01
5,026,010 A * 6/1991 Camarota ..... 248/188.1
5,110,080 A 5/1992 Rieman ..... 248/225.1
5,271,337 A 12/1993 Kolvites et al. ..... 108/107
5,279,231 A 1/1994 Kolvites et al. ..... 108/107
5,415,302 A 5/1995 Carlson et al. ..... 211/187
5,423,251 A 6/1995 Kolvites et al. ..... 108/110
5,482,168 A 1/1996 Welch et al. ..... 211/106
5,531,167 A 7/1996 Stevens et al. ..... 108/106

(Continued)

*Primary Examiner*—Jennifer E. Novosad
(74) *Attorney, Agent, or Firm*—Fitzpatrick, Cella, Harper & Scinto

(57) ABSTRACT

A wall-mounted shelving system includes a track and a bracket engagable with the track. The bracket has a collar for supporting a shelf-carrying pilaster and an engaging element protruding from the collar that includes a floor and an arm projecting upwardly from the floor to define an elbow. The track is adapted to be mounted horizontally on a wall and includes a downwardly open channel at its top and an outwardly projecting ledge at its bottom. The upper extreme of the engaging element arm is received in the channel of the track while the elbow can be supported to rest on the ledge. A pilaster is adapted to then be supported in the collar through an intermediate wedge member, and shelves and other objects can be supported on the pilaster.

5 Claims, 21 Drawing Sheets

U.S. PATENT DOCUMENTS

| | | | | |
|---|---|---|---|---|
| 5,601,038 | A | 2/1997 | Welch et al. | 108/193 |
| 5,645,257 | A | 7/1997 | Ward | 248/248 |
| 6,113,042 | A | 9/2000 | Welsch et al. | 248/218.4 |
| 6,116,436 | A | 9/2000 | Ferrucci et al. | 211/187 |
| 6,129,322 | A * | 10/2000 | Merkl | 248/213.2 |
| D462,541 | S | 9/2002 | Welch | D6/449 |
| 6,502,796 | B1 * | 1/2003 | Wales | 248/316.1 |
| 6,669,154 | B1 * | 12/2003 | Remmers | 248/225.11 |
| 6,837,384 | B2 * | 1/2005 | Secondino | 211/87.01 |
| 7,104,023 | B1 * | 9/2006 | Holztrager | 52/705 |
| 2004/0124163 | A1 * | 7/2004 | Perkins et al. | 211/94.01 |

* cited by examiner

WALL-MOUNTED SHELVING SYSTEM

CROSS-REFERENCE TO RELATED APPLICATION

This application claims the benefit of U.S. Provisional Patent Application No. 60/625,407, filed Nov. 3, 2004, which is incorporated herein by reference.

BACKGROUND OF THE INVENTION

1. Field of the Invention

This invention relates generally to the field of storage systems and more particularly to an improved wall-mounted shelving system in which one or more shelves can be easily mounted in cantilevered fashion to a wall using certain unique hardware. The unique hardware used in the wall-mounted shelving system of the present invention includes a mounting bracket that has an inverted frustoconical collar which receives a sleeve having a mating frustoconical outer surface and a cylindrical inner surface. The sleeve, in turn, embraces a pilaster in the form of a post. The bracket further includes an engaging member protruding from the collar, which is formed to engage a track mounted horizontally on a wall. Two or more posts may be carried on the track, and in turn the wall, using two or more such brackets and one or more shelves may then be supported on the posts. The system of the present invention may also be used to mount other objects and accessories, such as cabinets and supporting grids, on a wall.

Wall-mounted shelving systems of the type described have many applications in, for example, the food service and other general storage industries and environments.

2. Description of the Prior Art

Wall-mounted shelving systems are known and are available on the market in various forms. The walls with which such systems are designed to be used typically have a wall panel supported on underlying, vertically mounted studs. The known shelving systems generally include a plurality of vertically mounted uprights or pilasters secured to the wall, a plurality of shelves, and a plurality of brackets or supports for mounting the shelves on the uprights. It is desirable in such conventional systems that, in order to enhance the load-bearing capacity of the system, the uprights be secured directly to wall studs.

Although these known systems have utility in many applications, they suffer from a number of drawbacks. One common problem with such systems relates to their attachment to a wall. For example, in the case of the systems designed for use with typical stud-wall construction, there can be difficulties in attaching the system to the wall such that the system will be capable of supporting substantial weight. However, attaching the uprights of such system directly to the studs, as suggested above, makes the installation dependent on stud spacing, which can then constrain the shelf length to that spacing. Therefore, the location at which such a system can be mounted is limited.

In one crude solution to this problem, a wide strip, like a piece of wood, is attached horizontally to the face of the wall using fasteners secured directly into the underlying studs. The vertical uprights of the shelving system are, in turn, attached to the strip, but not necessarily to the underlying studs. In this way, placement of the uprights, and consequently the length of the shelves, is not limited by the spacing of the studs. However, a common problem with the resulting installation is that it is often unattractive. Further, such installation can involve additional cost and effort, and lacks flexibility, because the uprights are typically secured to the horizontal strip using convention fasteners like screws.

Another common problem with known wall systems relates to the actual task of attaching them to a wall. It can be difficult to arrange the components so that they are all in proper alignment, with the shelves extending horizontally in level fashion and at proper vertical spacing. Some existing systems, such as that described in U.S. Pat. No. 5,110,080 (Rieman), attempt to address both of these problems and those associated with attaching a horizontal strip or piece of wood to the face of the wall as explained above. Such systems typically include a horizontal track formed from sheet metal that is attached to the wall at the underlying wall studs to span the distance between at least two studs. Two or more uprights or pilasters are hung from the horizontal track, and shelf-supporting brackets are attached to the pilasters. The pilasters are also made of sheet metal and are formed as generally U-shaped channels.

A system similar to that shown and described in the Reiman Patent is offered commercially by Closet Maid under the trademark Shelf Track and is shown in FIG. 34. As can be seen there, the Closet Maid system includes a horizontal track having a downwardly open U-shaped upper channel, the back wall of which is formed by a web. That web terminates at its lower margin in a backwardly open U-shaped channel having a horizontal upper ledge projecting at substantially a right angle from the web. A pilaster in the form of a U-shaped channel, similar to that disclosed in the Reiman Patent, has an upper end received in the upper U-shaped channel of the track and opposing side walls that are formed with U-shaped notches that receive the lower backwardly open U-shaped channel of the track thereby to vertically support the pilaster.

While systems such as that shown in the Reiman Patent and offered by Closet Maid have advantages, there are also a number of additional drawbacks. First, the pilasters and the horizontal tracks typically have enclosed areas that are difficult to clean. This characteristic renders such systems less than desirable for use in many food service and other applications in which sanitation is important. More particularly, the pilasters in the form of U-shaped vertical channels have open regions behind them. The front webs of the pilaster channels are also provided with numerous openings or slots that mate with the shelf supporting brackets. Still further, the pilasters are typically open at the top and bottom. Accordingly, soil and vermin can enter the enclosed regions, which are not easily accessible for cleaning. In addition, the horizontal supporting track, such as that disclosed in the Rieman Patent, incorporates a lower lip that is angled upwardly in a way that can catch and retain contaminants. This acutely angled lip can also be hard to clean. Still further such systems are designed for use only with pilasters of a particular configuration and are not readily adapted to be reconfigured to support different style pilasters. And such systems generally are configured so that the pilasters can only be hung from the track, that is so that shelves and other accessories can only be carried on the pilasters at the level of the track or below it.

Another common problem in the known systems described above is that the pilasters and shelf brackets typically have limited load-carrying capability. Where heavy loads are to be expected, it is often necessary to use many pilasters, which can increase the cost and the complexity of the system and provide even more regions that are difficult to clean.

There exists, therefore, a need for an improved wall-mounted shelving system that overcomes these and other drawbacks associated with prior art systems. The improved wall-mounted system should ideally be capable of supporting heavy loads without being limited in its placement by wall studs, and should be easy to clean. The system should also be cost effective and simple to install.

SUMMARY OF THE INVENTION

It is an object of the present invention to provide a simplified wall-mounted shelving system that offers advantages over prior art systems. In particular, it is an object of the present invention to provide a wall-mounted shelving system that is easy to install, allows for shelf placement which is not limited by stud location, holds heavy loads, and is readily cleaned.

It is still another object of the invention to provide a wall-mounted shelving system that can be easily configured and reconfigured to meet a user's needs, particularly as those needs change, and with little or no additional damage or disturbance to the underlying wall.

It is still another object of the present invention to provide a wall-mounted shelving system that is capable of incorporating a grid system for storing a wide variety of articles thus expanding storage flexibility.

It is another object of the invention to provide a wall-mounted shelving system that is capable of supporting other objects such as an enclosed cabinet for holding various items.

It is, therefore, an object of the present invention to provide an improved wall-mounted shelving system incorporating structure for carrying shelf-supporting pilasters or posts that, in a preferred embodiment, comprises a mounting bracket that includes means for carrying the pilasters. In one preferred embodiment such means comprise an inverted frustoconical collar, a sleeve having an inverted frustoconical outer surface that mates with the collar, and a cylindrical inner surface that embraces a post. An engaging member protrudes from the collar and is formed to engage a horizontal track mounted on the wall. The horizontal track may be made of sheet metal and includes a downwardly opening U-shaped channel formed at its upper horizontal margin or edge. The track is further formed with a horizontally extending lower ledge joined to the upper U-shaped channel by a vertically extending web. The web and ledge together define a V-shaped notch.

The engaging member included in the bracket also includes a horizontal floor projecting sidewardly from the collar and an arm projecting upwardly, inwardly from the floor at an acute angle to define an elbow. The arm has a vertical extent such that its upper edge can be received in the upper U-shaped channel of the horizontal track with the elbow received in the V-shaped notch of the track to be supported by the ledge in the downward direction.

The ledge formed at the lower margin of the vertical web can, for example, be a single thickness of sheet metal or may be formed as a U-shaped channel that opens backwardly toward the wall on which the track is mounted.

The structure of the collar on the bracket and the associated sleeve-and-post assembly may be essentially the same as that described in U.S. Pat. No. 3,424,111 (Maslow) and U.S. Pat. No. 3,523,508 (Maslow), with the exception that the frustoconical collar and sleeve in the bracket of the present invention are oriented to open upwardly, that is thus are inverted, rather than opening downwardly. (The Maslow Patents noted above are incorporated in their entireties herein by reference.) The collar has a larger diameter at its upper end than at its lower. According to the principles of the Maslow Patents, when a post is downwardly loaded a sleeve embracing it will be forced downwardly into the mating collar in the mounting bracket. This downward force produces a wedge-like action between the collar and sleeve causing the sleeve to embrace radially and support more tightly the post as the load on it increases. This design permits the post to be engaged with the bracket either to depend from it or project above it. If the post is installed on the bracket to project above it, shelves may be mounted on posts at locations above the track.

One or more shelves constructed in accordance with the Maslow Patents may then be mounted on the post employing the general principles described in them.

Posts, collars and sleeves of configurations other than that disclosed by the Maslow Patents are also contemplated by the present invention, as will be explained in greater detail below. Further, other structures for carrying a pilaster or post in a mounting bracket that produces a wedge-like action between the post and bracket are also envisioned.

In another embodiment, the track may be formed with a vertically extending web, a lower ledge and an upper roof projecting sidewardly away from the supporting wall from the web, a lower flange projecting downwardly from the ledge and upper flange projecting from the roof. A mounting bracket includes a lower floor formed to rest on the ledge of the track and an upper downwardly open hook formed to embrace the upper flange of the track. This alternative bracket also incorporates means, as described above, for carrying a pilaster such as a post.

Additional hardware is also contemplated by the present invention for mounting structures other than shelves, such as grids and enclosed cabinets, on a wall.

These and other objects, aspects, and features of the present inventions will be more clearly understood by reference to the following detailed description of exemplary embodiments provided in conjunction with the accompanying drawings.

DETAILED DESCRIPTION OF THE PREFERRED EMBODIMENTS

The present invention will now be described with reference with certain exemplary embodiments. However, it should be understood by those skilled in the art that various modifications can be made to the described embodiments without departing from the spirit or scope of the present invention or the concluding claims. Moreover, it is to be understood that terms such as "upper", "lower", "upwardly", "downwardly", "top" and "bottom" are used in this specification and the concluding claims to refer to orientations of and locations on various components as if they are in their installed states.

In a preferred embodiment of the present invention, a wall-mounted shelving system is provided that incorporates unique hardware that constitutes a substantial improvement over the known prior art. This hardware desirably makes use of the fundamental principles of the Maslow Patents cited above in a new and different way, but may also be adapted to other configurations. In the preferred embodiment, the hardware comprises a mounting bracket that includes an inverted frustroconical collar, that is, a collar having a larger diameter at its top than at its bottom. A sleeve is formed to mate with the collar and has a similarly inverted frustoconical outer surface and a cylindrical inner surface that embraces a post. An engaging member protrudes from the collar and is formed to engage a track mounted horizontally on a wall. One or more shelves may then be mounted on one or more posts carried on the track which is, in turn, mounted on the wall.

Preferred embodiments of this basic structure of the present invention will now be described in detail with reference to the accompanying drawings.

Figure 1:
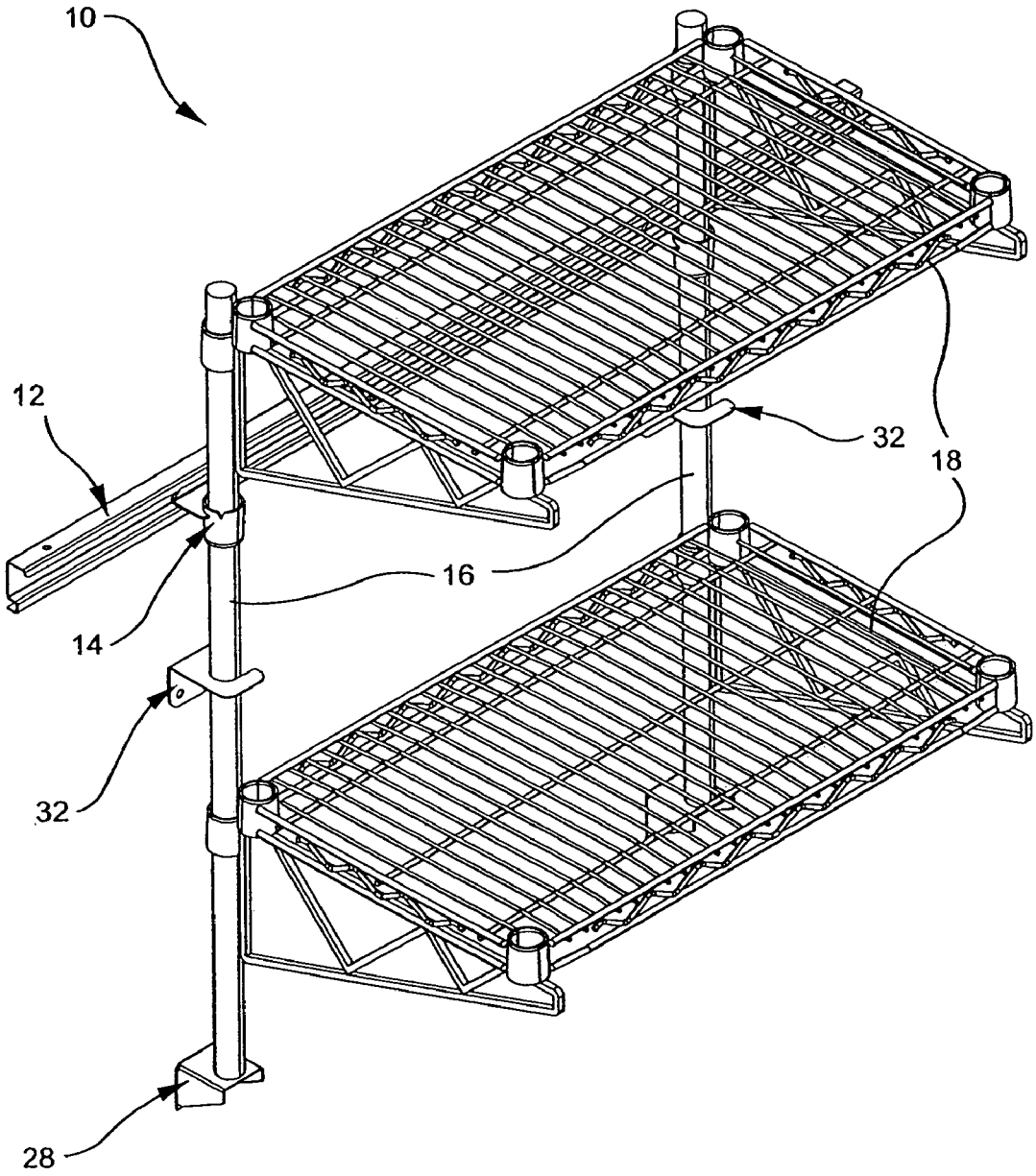
FIGS. 1 and 2 are perspective views of the wall-mounted shelving system in accordance with one embodiment of the present invention, in which a horizontal track and mounting brackets engaged with the track support two round vertical posts and, in turn, two shelves.
Figure 2:
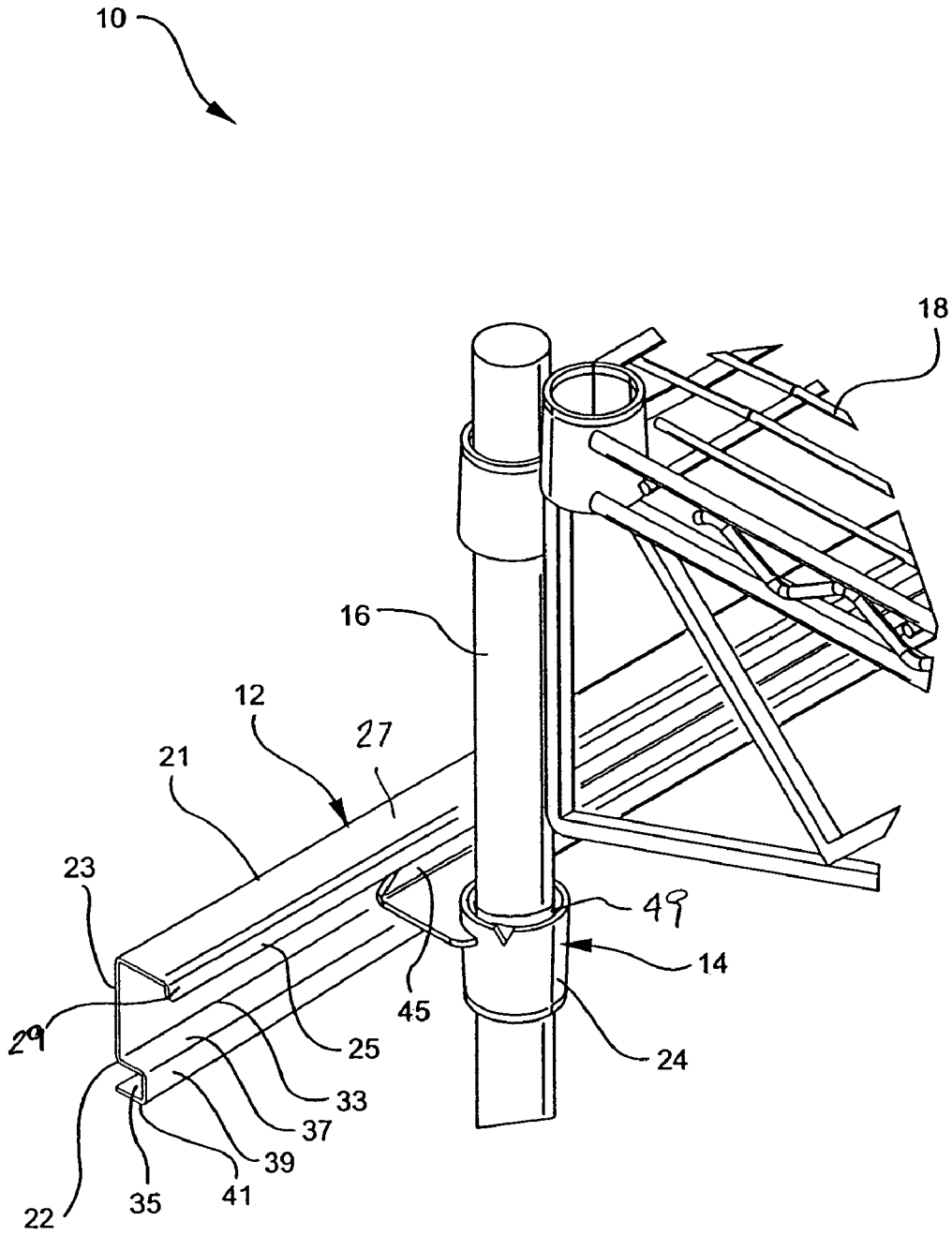
Figure 3:
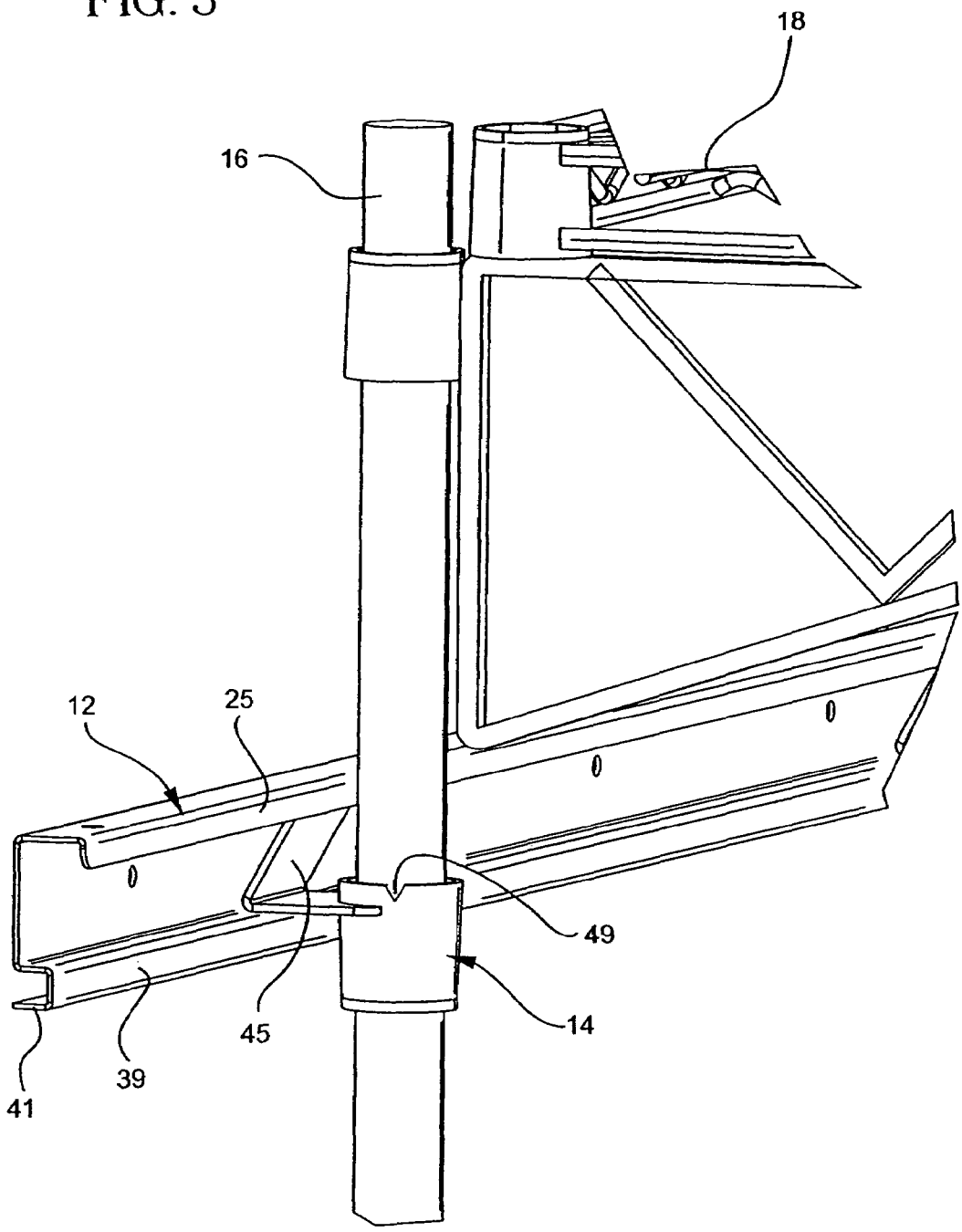
FIG. 3 is an enlarged perspective view of the track, the mounting bracket and the support post illustrated in FIGS. 1 and 2.

FIGS. 1 to 3 illustrate the wall-mounted shelving system 10 of the present invention according to a preferred embodiment as including a horizontal track 12, mounting brackets 14 that engage the track 12, and round, vertically extending posts 16. The brackets 14 support the posts 16 relative to the track 12, and the posts 16 and the brackets 14 can support one or more shelves 18. FIG. 3 is an enlarged perspective view showing how a bracket 14 is engaged with the track 12 and how a post 16 is supported in the bracket.

Figure 14:
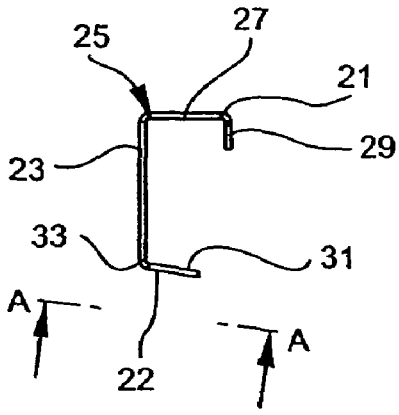
FIGS. 14, 15, and 16 are respectively side elevational, front elevational and bottom angled views (FIG. 16 being taking from plane A-A in FIG. 14) of the horizontal track in accordance with the present invention.
Figure 15:
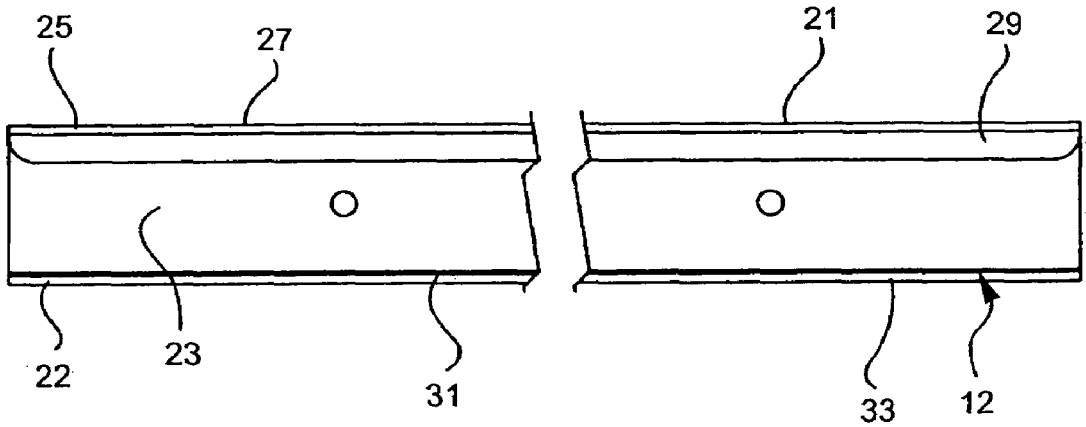
Figure 16:
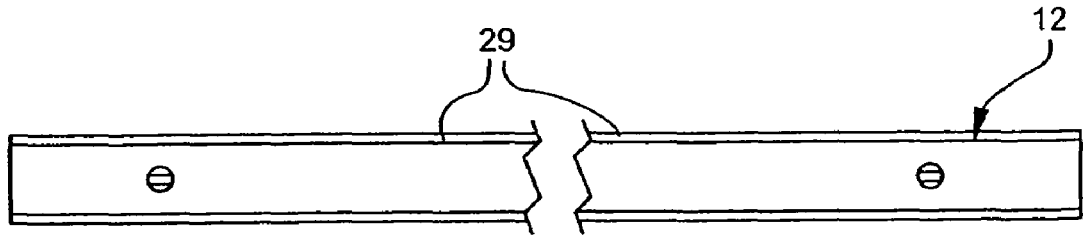
Figure 34:
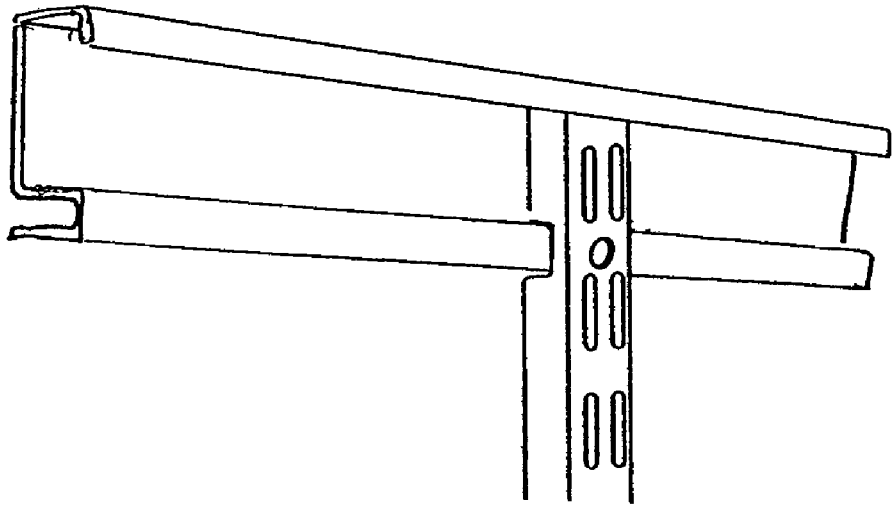
FIG. 34 is a perspective view of a track and pilaster in accordance with the prior art.

FIGS. 2 and 3 and FIGS. 14, 15, and 16 show alternative configurations of the track 12, which in both designs may be formed of sheet metal. The version of the track shown in FIGS. 2 and 3 may be the same as that commercially available from Closet Maid under the trademark Shelf Track and shown in FIG. 34. That shown in FIGS. 14 to 16 is an improvement on that configuration. Each design has an upper region 21 and a lower region 22 joined by a vertical web 23. The upper region 21 is formed with a downwardly open U-shaped channel 25, defined by the web 23, a top wall 27, and a depending tab 29. As shown in FIGS. 14 to 16, in one configuration the lower region 22 is formed as a single thickness of sheet metal to define a ledge 31 that projects downwardly and outwardly from the web 23, thereby to define a notch 33. Alternatively, as shown in FIGS. 2 and 3 in accordance with the Closet Maid product, the lower region may be configured from bent sheet metal as a backwardly open U-shaped channel 35 defined by a ledge 37, a depending front wall 39 and a backwardly projecting bottom wall 41.

The track 12 is secured to a wall in conventional fashion preferably using fasteners such as screws secured in the underlying wall studs.

Figure 4:
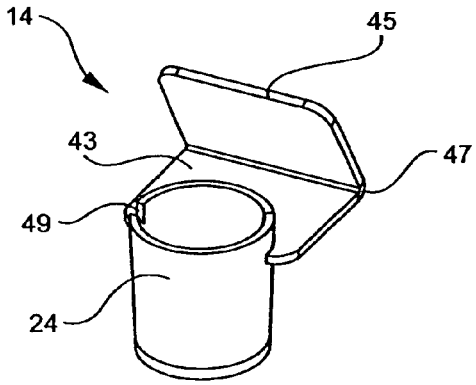
FIGS. 4, 5, and 6 respectively are front perspective, side elevational, and top plan views of the mounting bracket according to one embodiment of the present invention.
Figure 5:
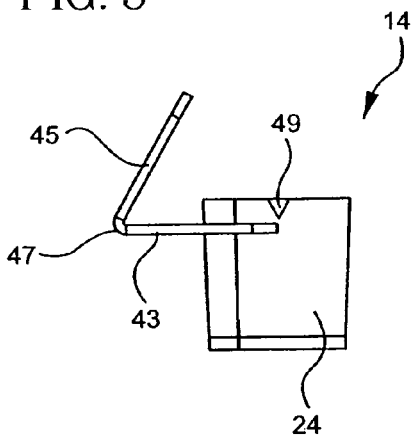
Figure 6:
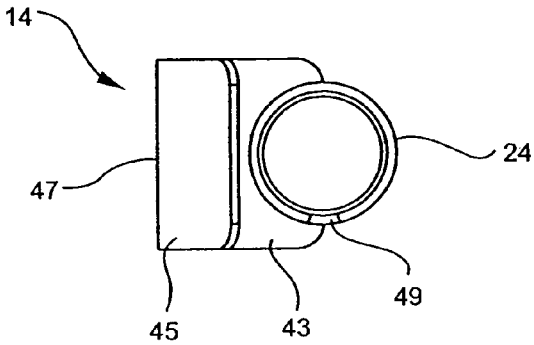

FIGS. 4 to 6 show a mounting bracket 14, which is engaged with the track, in greater detail. It includes an inverted frustoconical collar 24, a floor 43 projecting radially from the collar, and an arm 45 projecting upwardly inwardly, that is toward the axis of the collar 24, to define an acute angle that forms an elbow 47. The collar thus defines a surface inclined upwardly and outwardly from its axis.

A split sleeve 49 shown in FIG. 2 cooperates with the collar and has a frustoconical outer surface and a cylindrical inner surface. The outer and inner surfaces thus define a wedge thicker at the top than at the bottom. The sleeve has a radially inwardly projecting bead (not shown) and the post 16 has complementary spaced annular grooves (not shown) that cooperate to locate the post relative to the sleeve, such that the sleeve embraces the post at a desired location in the manner described in the Maslow Patents referenced above. Therefore, as the post 16 is loaded downwardly, a wedge-like action between the sleeve and collar creates a radially inwardly directed force on the post to grip it tightly.

Figure 7:
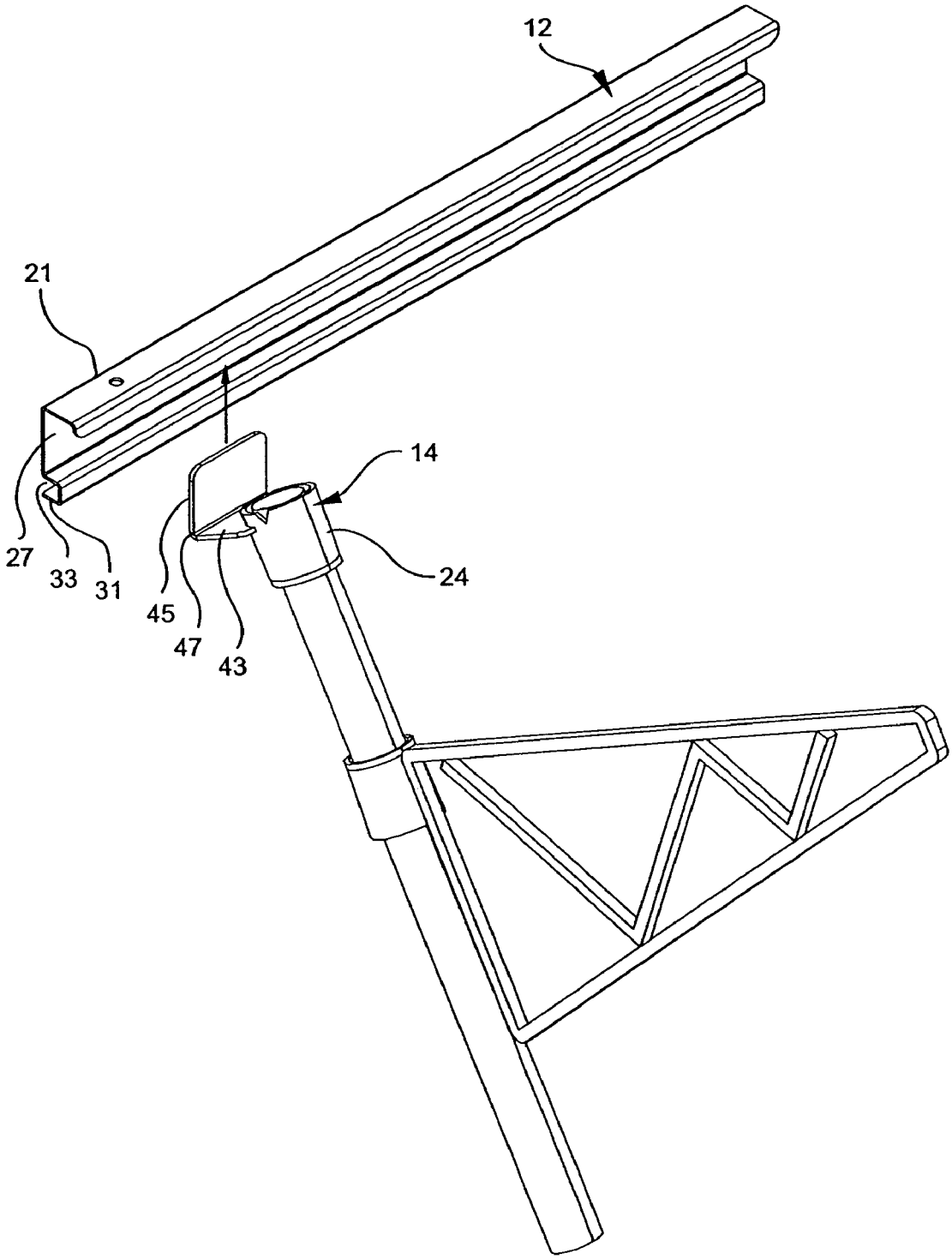
FIGS. 7, 8, and 9 are perspective views progressively illustrating how a mounting bracket and post in accordance with the invention are assembled with a horizontal track.
Figure 8:
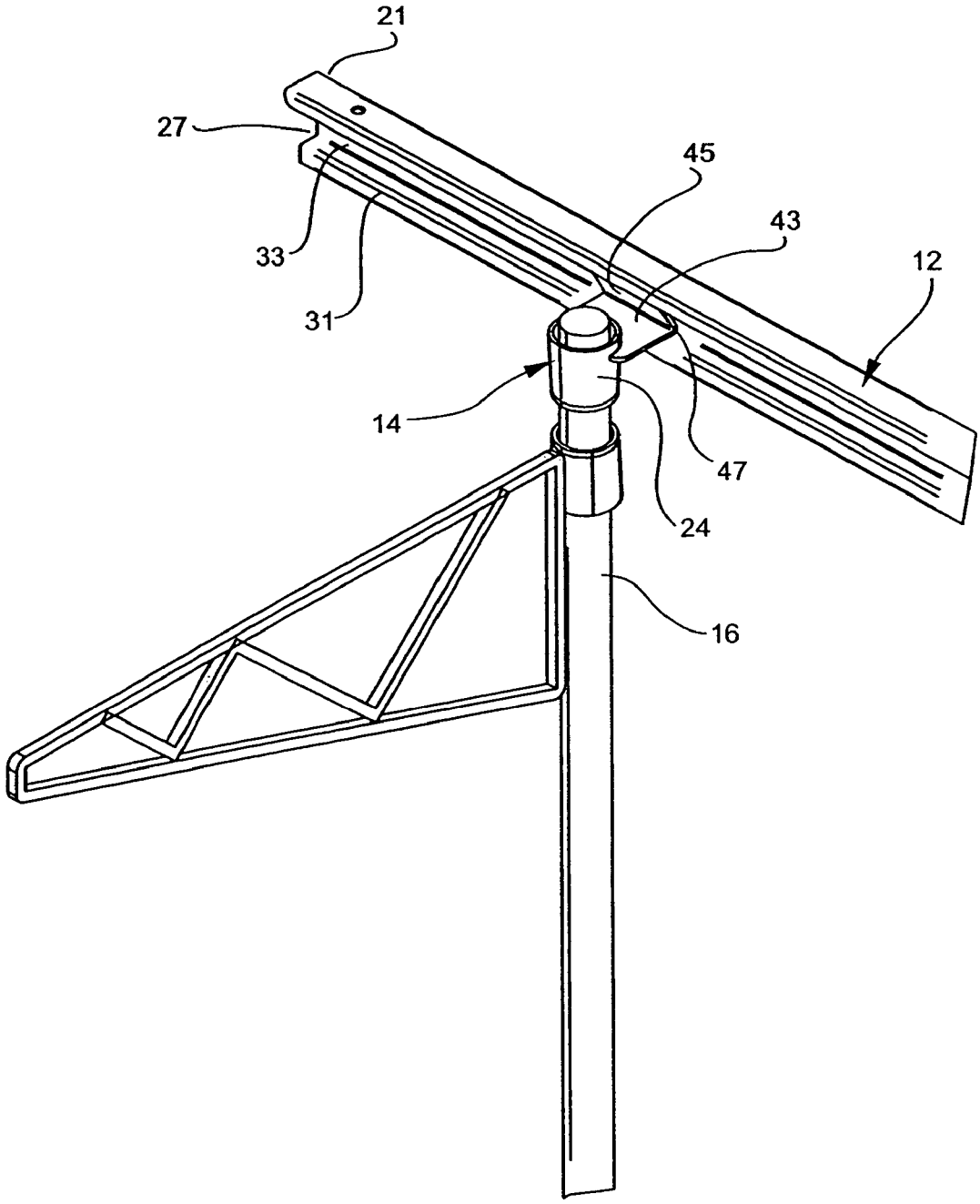
Figure 9:
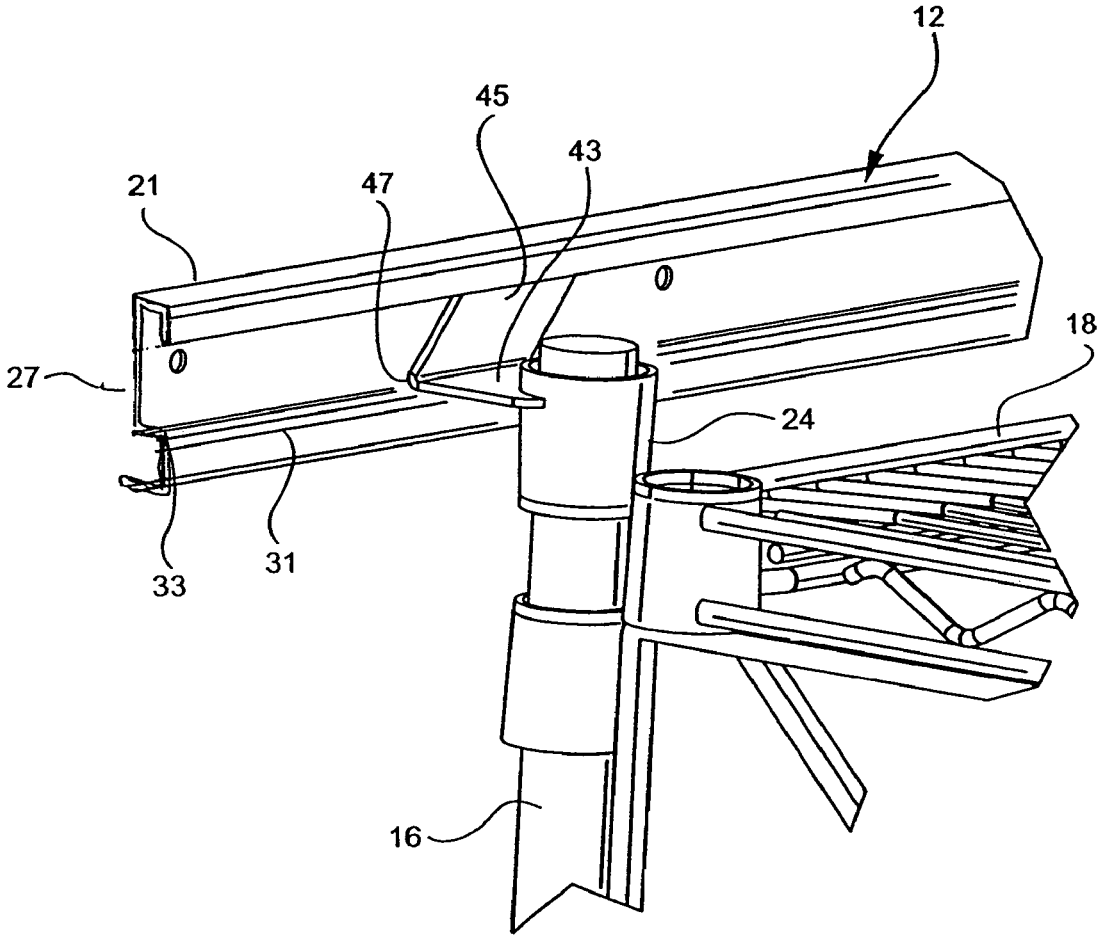

Referring now to FIGS. 3, and 7 to 9, mounting of a bracket 14 on the track 12 will now be described. The bracket, whether or not assembled with a post, is tilted outwardly so that the upper edge or extreme of the arm 45 is received in the channel 27 in the upper region 21 of the track (FIG. 7). The bottom of the collar or of a post mounted with the bracket can then be rotated toward the wall such that the bracket elbow 47 engages and rests in the notch 33 and on the ledge 31 of the track 12 (FIGS. 8 and 9). The bracket and a post carried in it thus becomes supported vertically on the track.

It will also be appreciated that the bracket can be inserted from an end of the track and slid to the desired location. And it will be appreciated that the bracket can be mounted at any point on the track, not just in the region of an underlying wall stud.

In the embodiment of the track shown in FIGS. 2 and 3, the ledge 31 may project horizontally form the web. However, this embodiment may be improved by forming the ledge to be inclined downwardly outwardly at a slight angle. Similarly, in the embodiment shown in FIGS. 14 to 16, the ledge 31 is angled downward outwardly at a slight angle. This downward outward inclination of the ledge causes it to shed dirt and moisture and to aid in insertion of the brackets as described above. In both cases, the load bearing point between the track and bracket is located close to the wall in order to resist bending of the ledge.

It is also noted that in some applications the configuration of the track shown in FIGS. 2 and 3 may be preferable to that shown in FIGS. 14 to 16, because the former provides enhanced stiffness and resistance to twisting or bending when loaded at locations spaced from the underlying wall studs.

Once one or more posts are mounted on the wall as explained above, one or more shelves can be mounted on the posts to complete the system as shown in FIGS. 1 and 2. Hardware for so mounting the shelves is available from Inter-Metro Industries Corporation, an affiliate of the assignee of the present invention, under the trademarks SUPER ERECTA SHELF®.

Figure 10:
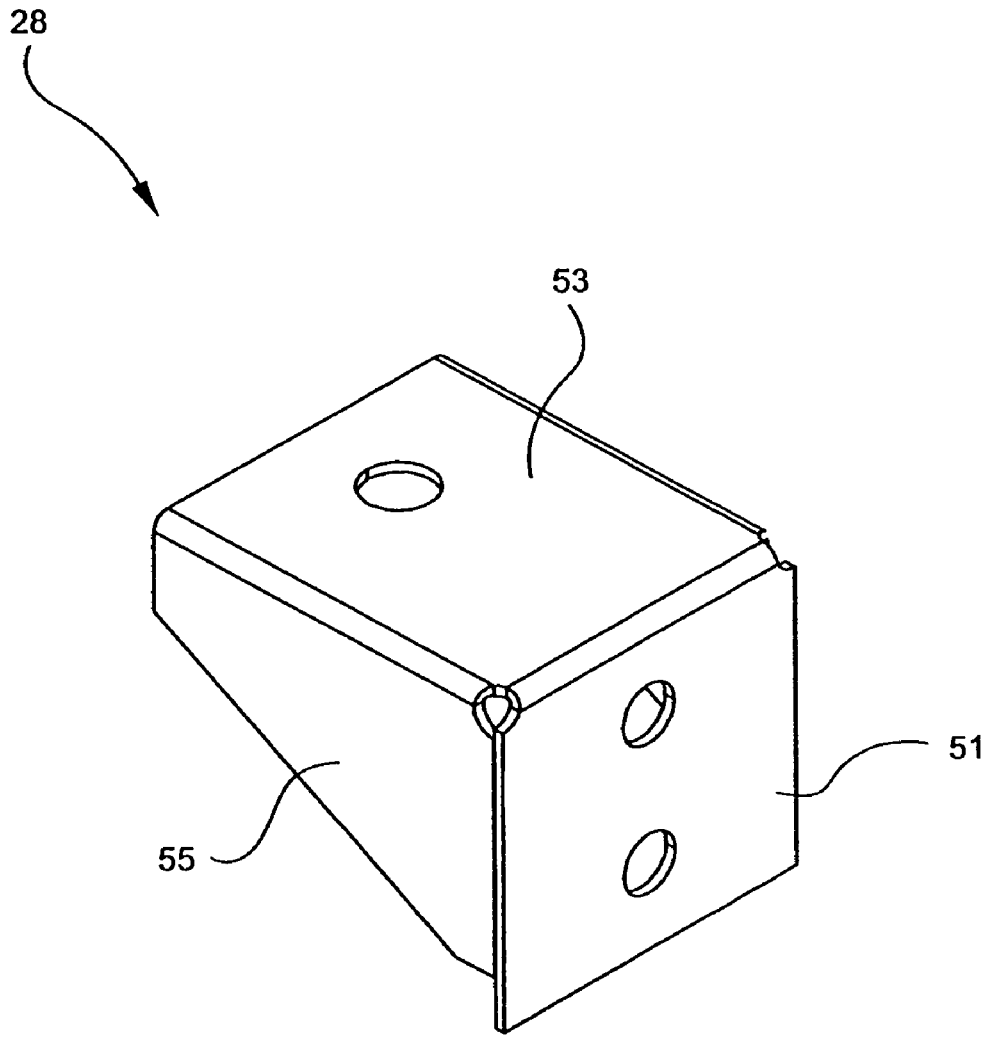
FIG. 10 is a perspective view of a lower post retainer that is used to assist in stabilizing the lower end of a post in accordance one embodiment of the present invention.
Figure 11:
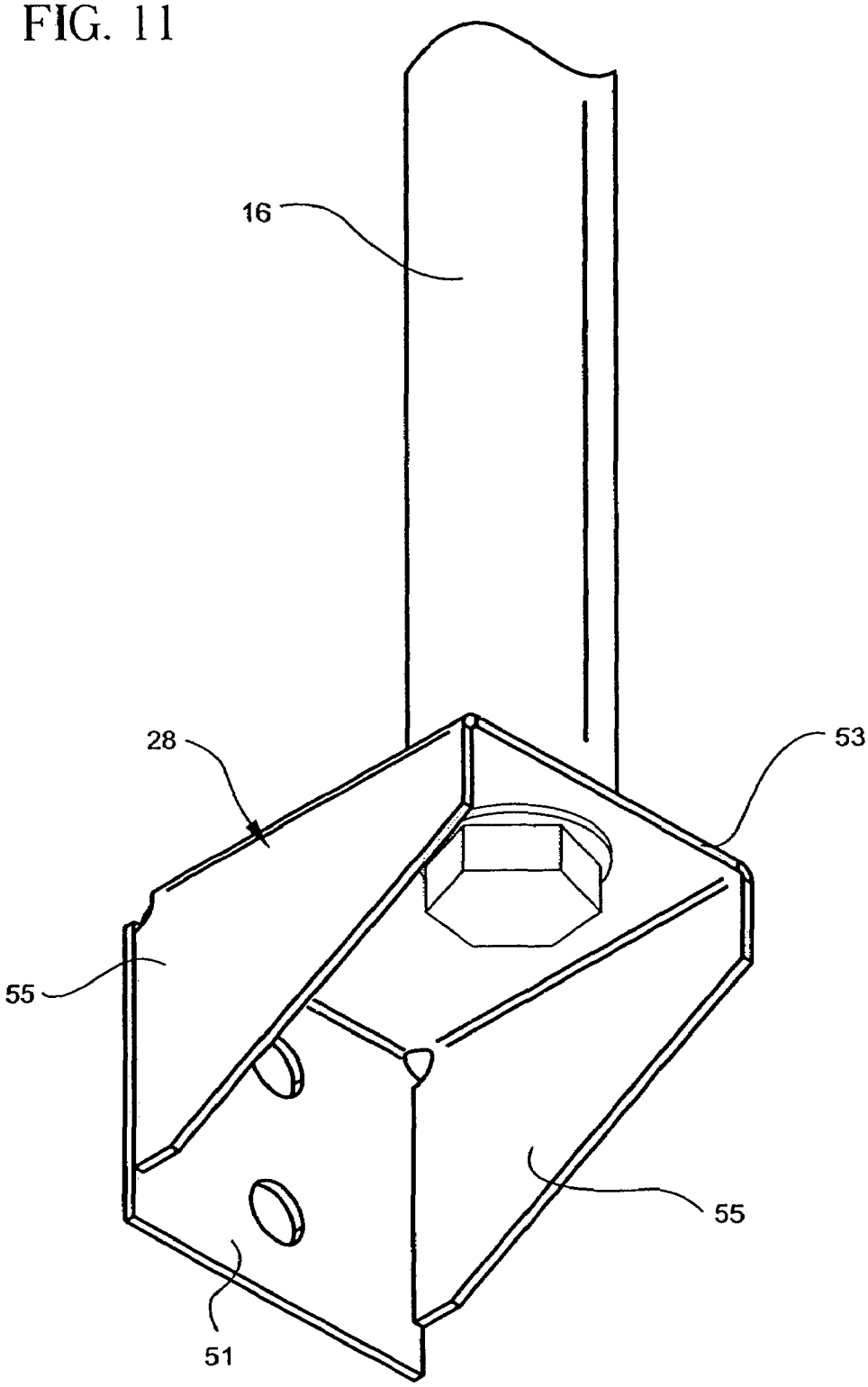
FIG. 11 is a perspective view of the lower post retainer assembled with a post.

FIG. 10 illustrates a lower post retainer 28 that can be used to assist in stabilizing the lower end of a post 16 mounted through a bracket to a track as described above, and FIG. 11 illustrates the use of that retainer 28.

As shown in those figures, the retainer includes a rear wall 51, a top wall 53 and depending sidewalls 55. The retainer is secured to the supporting wall near the bottom of the post by suitable means such as a screw. Another fastener, such as a bolt, is then tapped through the top wall 53 into the bottom of the post 16. This lower post retainer 28 thus functions to prevent angular movement of the post 16 away from vertical as shelves are loaded. While in many instances it is not necessary to fasten the lower post retainer 28 to the wall, such retainer attachment is helpful in stabilizing the system and in bearing additional load.

Figure 12:
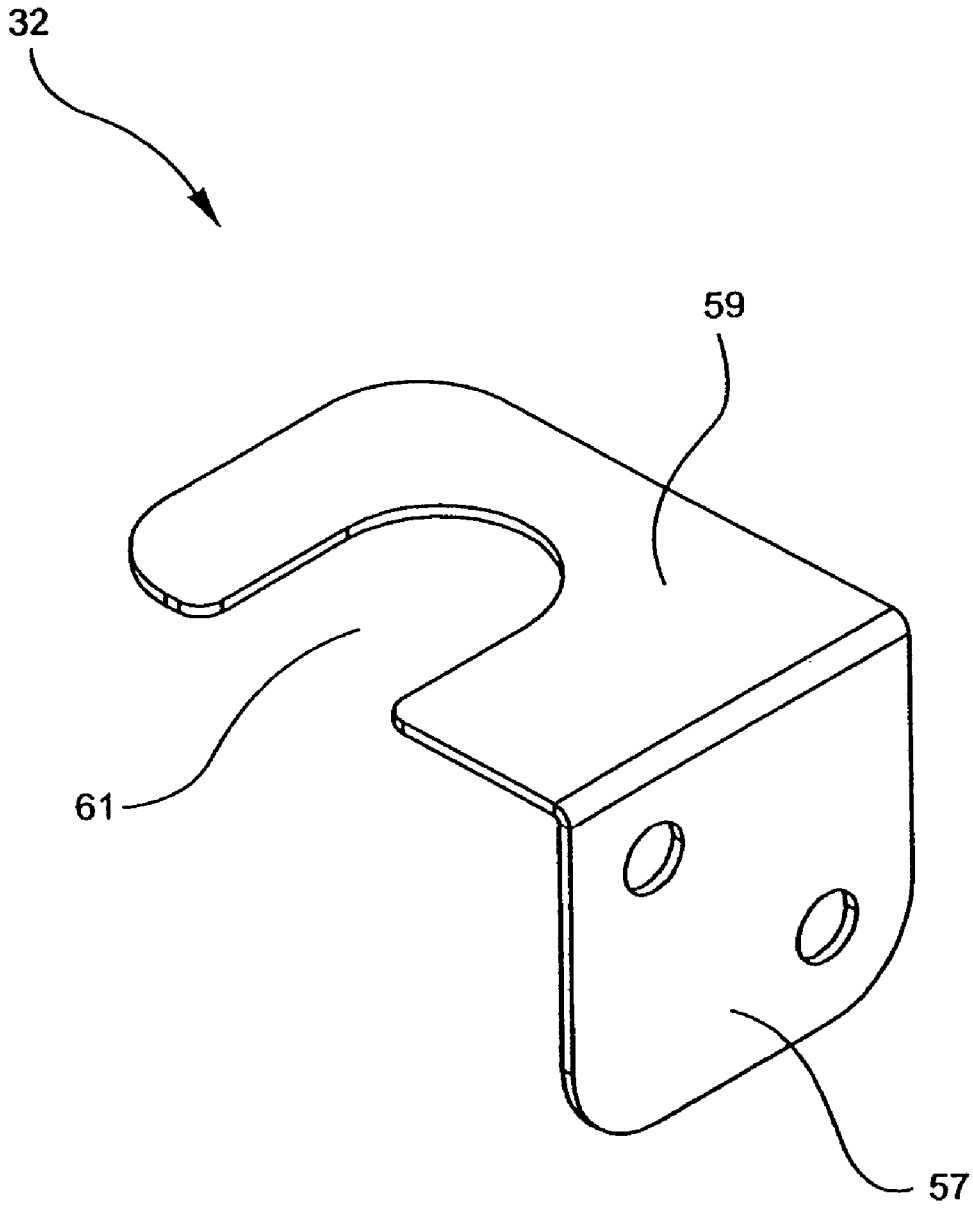
FIGS. 12 and 13 are respectively perspective views of an intermediate post retainer and of the post retainer engaged with a post in accordance with a feature of the present invention.
Figure 13:
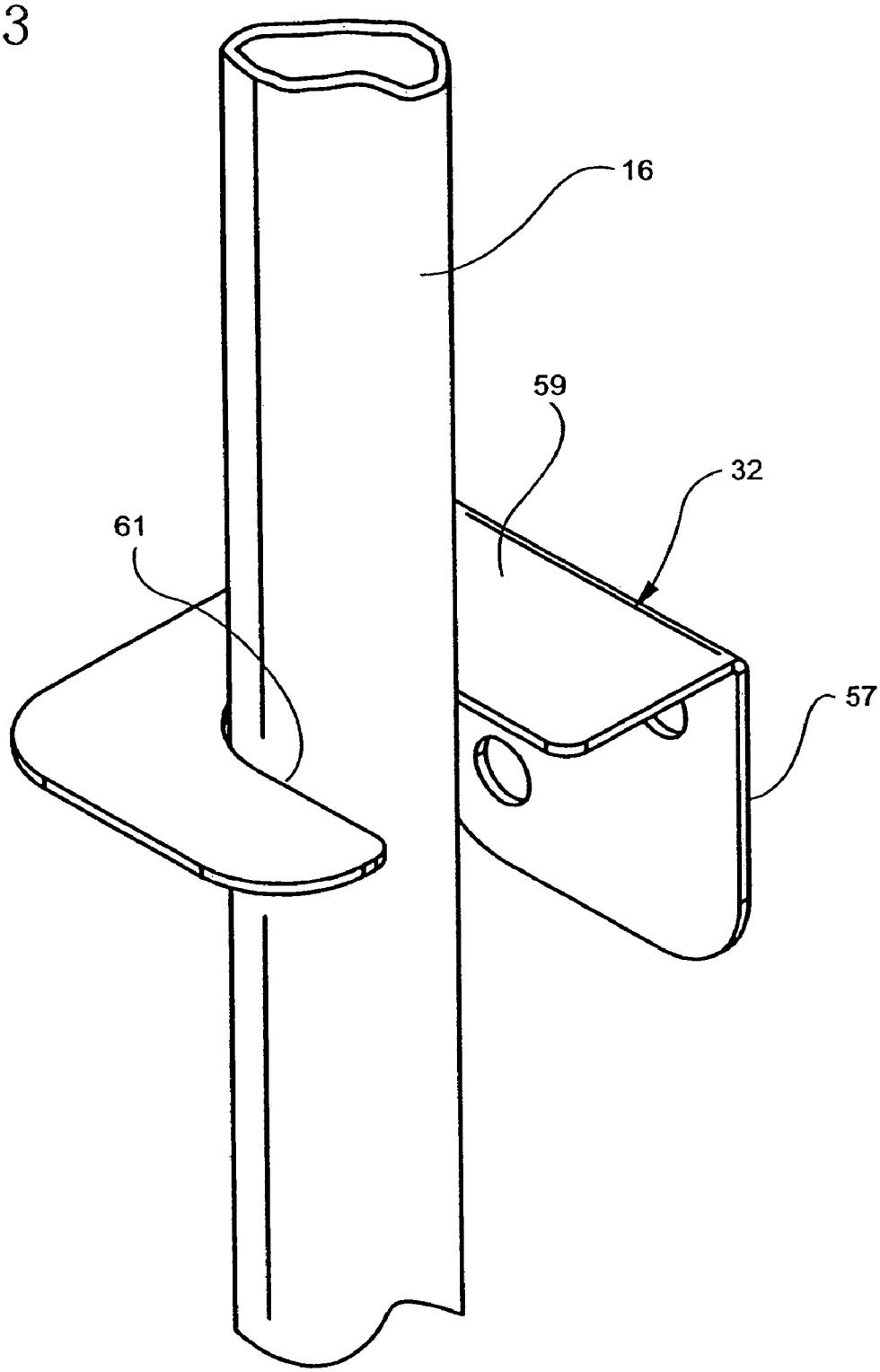

FIGS. 12 and 13 illustrate an intermediate post retainer 32 optionally used in some embodiments to further assist in vertically stabilizing a post. As shown in FIG. 12 the intermediate retainer 32 includes a rear wall 57 and a top wall 59 formed with a cut-out section 61. As shown in FIG. 13 the retainer may be secured to the underlying wall by a suitable fastener such that an intermediate portion of the post is received in the cut-out section 61. This structure can be especially useful when long posts are used in combination with heavy loads, in order to resist deformation of the posts into an s-shape, which could result in excessive deflection of the mounted shelves.

Using the wall-mounted shelving system as described thus far, it is possible to provide the functionality of known systems while adding the benefits described earlier. The present invention is easy to install and is not limited in its placement of shelves 18 by the location of wall studs. Additionally, the shelves and supporting structures can be easily removed or relocated without moving the horizontal track. In addition, use of enclosed posts or pilasters, and configuration of the track with a downwardly open upper channel and a downwardly outwardly inclined ledge make the system less likely to collect contaminants and also easy to clean.

Again, it will be understood that other structures for coupling upright supports, such as the posts described above, to the supporting brackets are contemplated by the present invention. For example, while the posts are described above as round or cylindrical, they and the cooperating collars and sleeves may take different forms. For example, U.S. Pat. Nos. 6,113,042 (Welsch, et al.); 5,423,251 (Kolvites, et al.); 5,279,231 (Kolvites, et al.); and 5,271,337 (Kolvites et al.) describe suitable alternative structures wherein the posts, collars, and cooperating wedges are triangular or partially triangular in cross-section. Each of these patents is incorporated herein in its entirety by reference. Still other structures in which uprights or pilasters and carried by a mounting bracket configured to engage a track as described above, but which do not incorporate wedge-like components, are also with the scope of the present invention.

Figure 17:
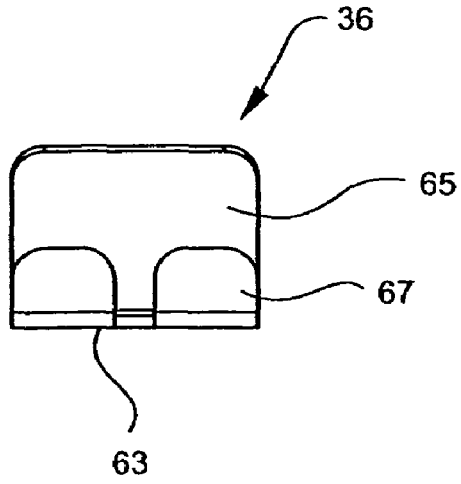
FIGS. 17, 18, and 19 are respectively front elevational, bottom plan and side elevational views of a bracket for mounting a grid with the horizontal track.
Figure 18:
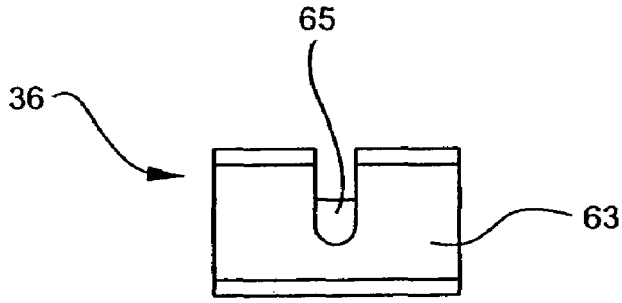
Figure 19:
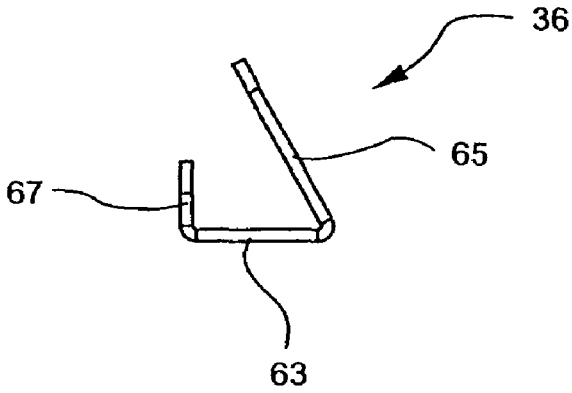
Figure 20:
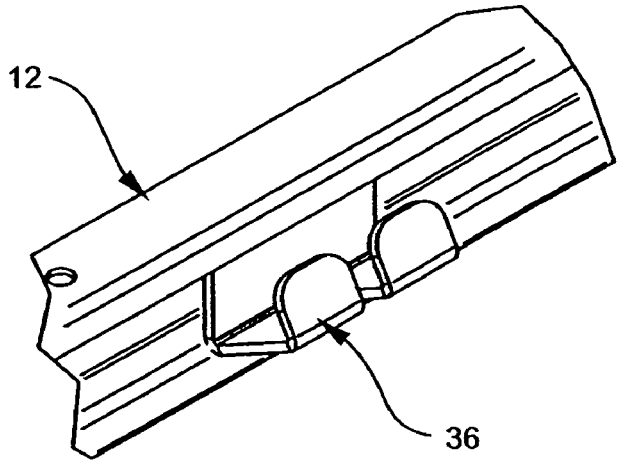
FIGS. 20, 21 and 22 are respective perspective views showing how the bracket illustrated in FIGS. 17 to 19 is used to mount such a grid.
Figure 21:
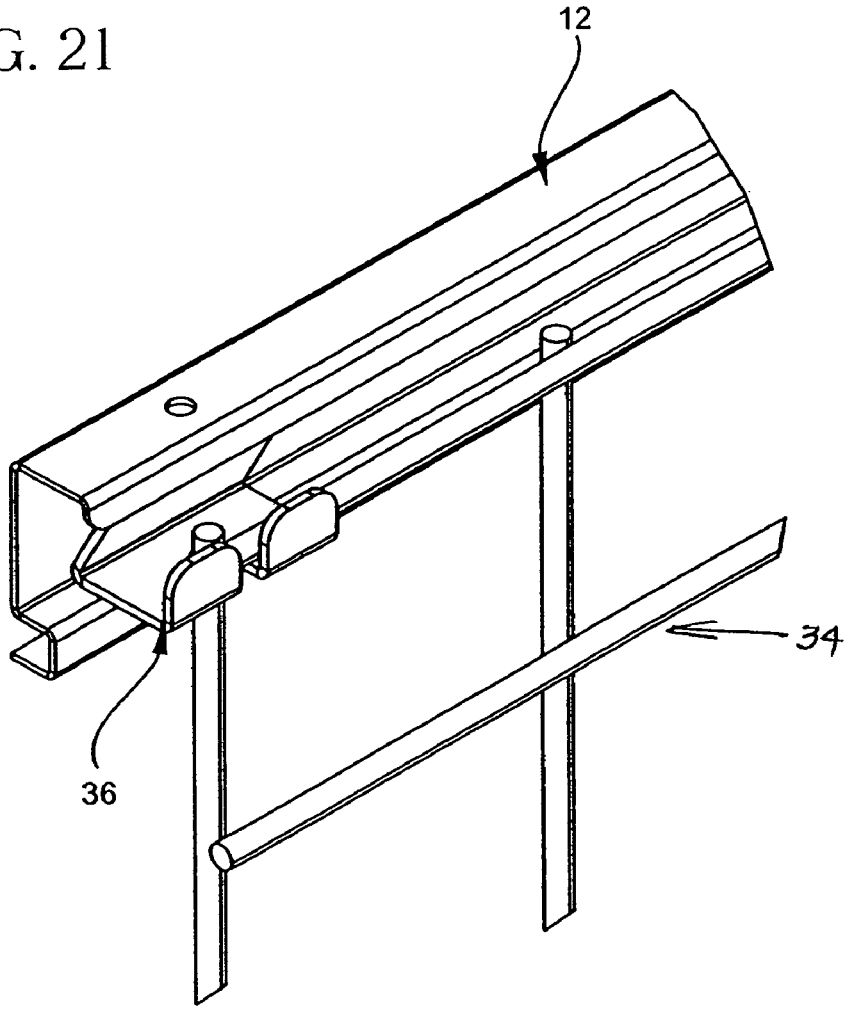
Figure 22:
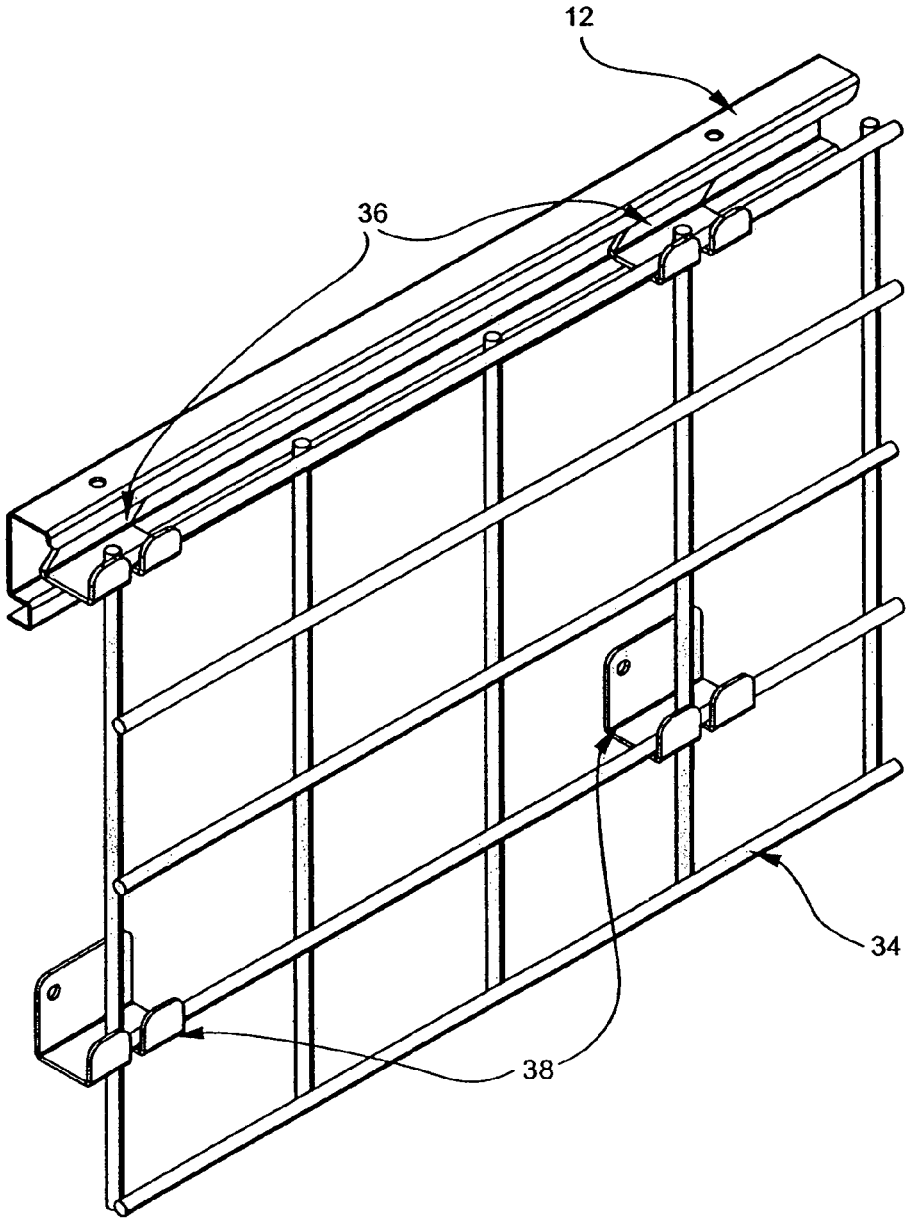

FIGS. 17 to 19 illustrate a bracket or clip for mounting a grid to the system and FIGS. 20 to 22 show how this bracket is used in the present invention. In a preferred embodiment, the grid 34 may be used to mount a wide variety of items on the supporting wall through the track in a manner, for example, as described in U.S. Pat. No. 5,482,168 (Welch, et al.), which is also incorporated herein in its entirety by reference.

Accordingly, the grid 34 is a mat formed by intersecting horizontal and vertical grid rails. The grid rails may be made of any material suitable for supporting a wide variety of items, and in the preferred embodiment are metal wires joined together by welding at the points of intersection. Alternatively, the grid rails may be made of plastic, formed by injection molding or other techniques.

A grid-mounting bracket or clip 36 is shown in FIGS. 17 to 19 and its attachment to a track 12 is shown in FIGS. 20 to 21. The grid mounting clip 36 is preferably formed of sheet metal and includes a floor 63, an upwardly extending arm 65 formed at an acute angle with the floor, and slotted up 67 projecting upwardly from the floor at a right angle. The clip 36 may be installed in the track 12 in the same manner as is the mounting bracket 14 as was shown with reference to FIGS. 20 to 22. The grid 34 may then simply be hung on the clip 36 as shown in FIGS. 21 and 22 with a horizontal grid rail supported on the floor and retained by the lip, and with a vertical grid rail received in the slot in the lip.

Figure 23:
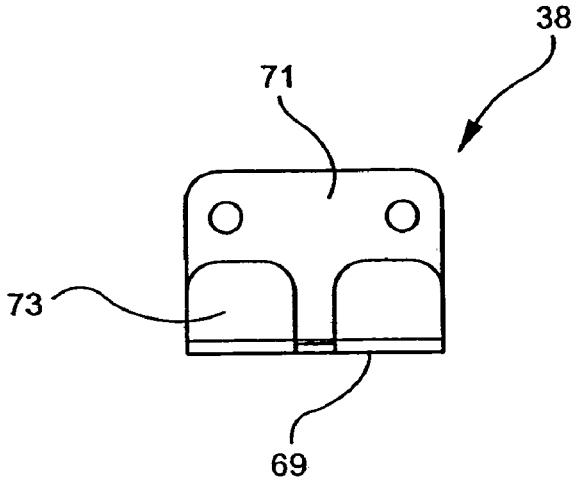
FIGS. 23, 24, and 25 are respectively front elevational, bottom plan and side elevational views of a wall bracket for stabilizing a grid supported on the brackets show in FIGS. 20 to 22.
Figure 24:
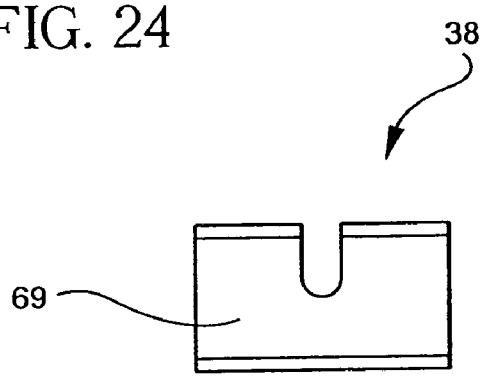
Figure 25:
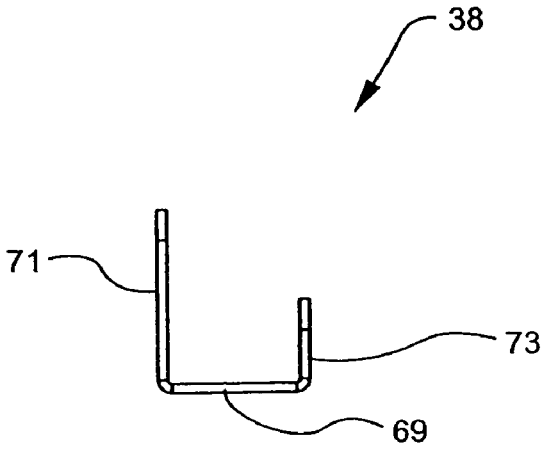
Figure 26:
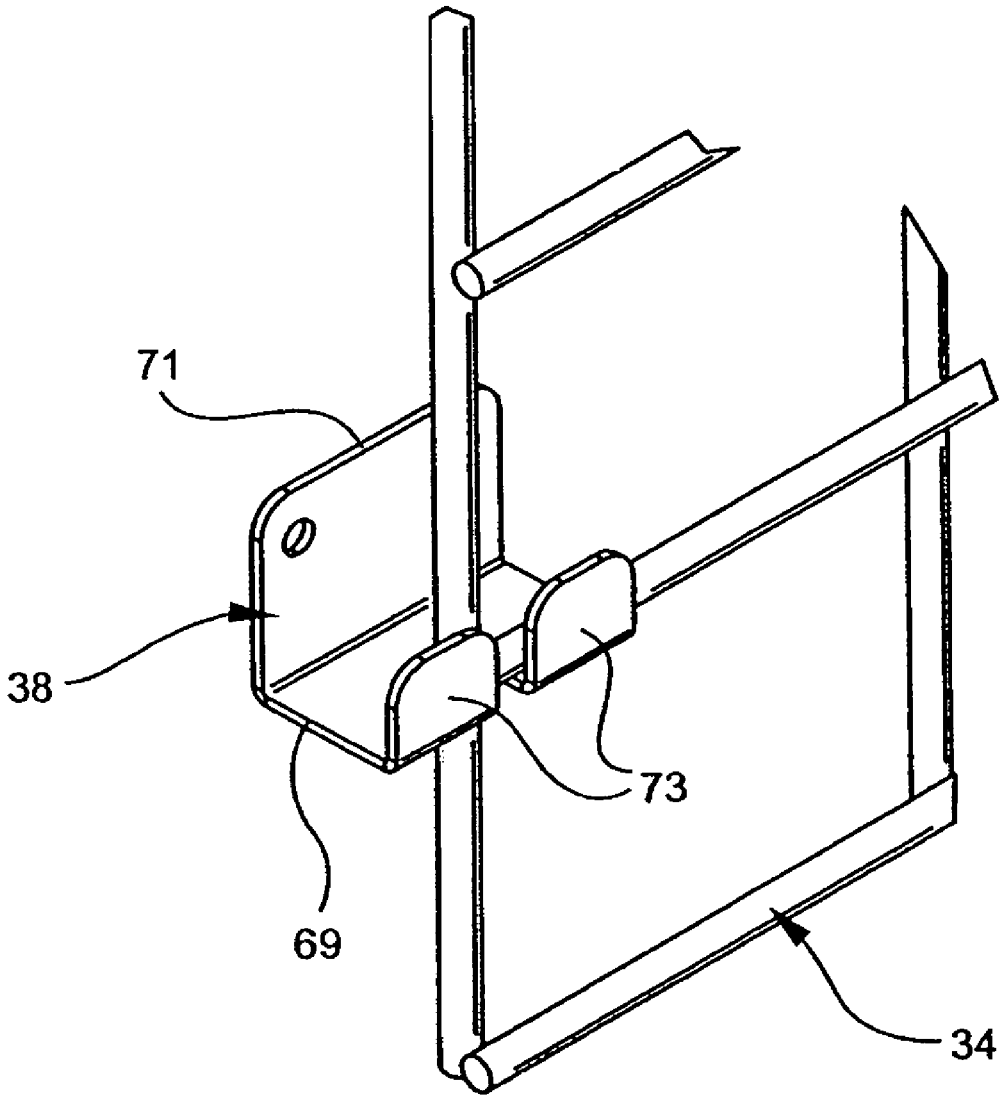
FIG. 26 is a perspective view showing how such bracket is used.

FIGS. 23 to 25 illustrate a lower bracket or clip 38 that can be used to stabilize and further support lower portions of a grid 34 if deemed necessary for a specific installation. This clip may also be made from sheet metal and has a floor 69, a rear wall 71 and a front wall 73 both projecting upwardly at right angles from the floor. A slot again is formed in the front wall and floor. The clip may be secured to a support wall by suitable fasteners as shown in FIG. 26 to receive and support a horizontal grid rail and accommodate a vertical grid rail as shown there.

Figure 27:
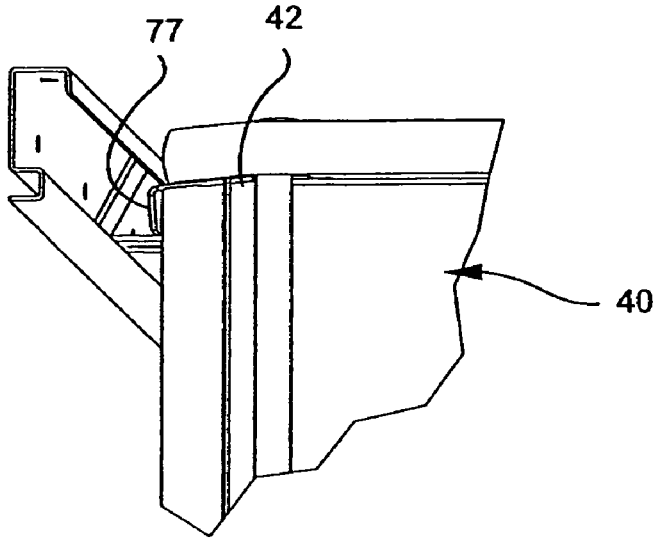
FIGS. 27 and 28 are perspective views illustrating how a cabinet can be mounted on a wall using hardware in accordance with the present invention with a hanger carried on the top of the cabinet and spacer attached to the bottom of the cabinet.
Figure 28:
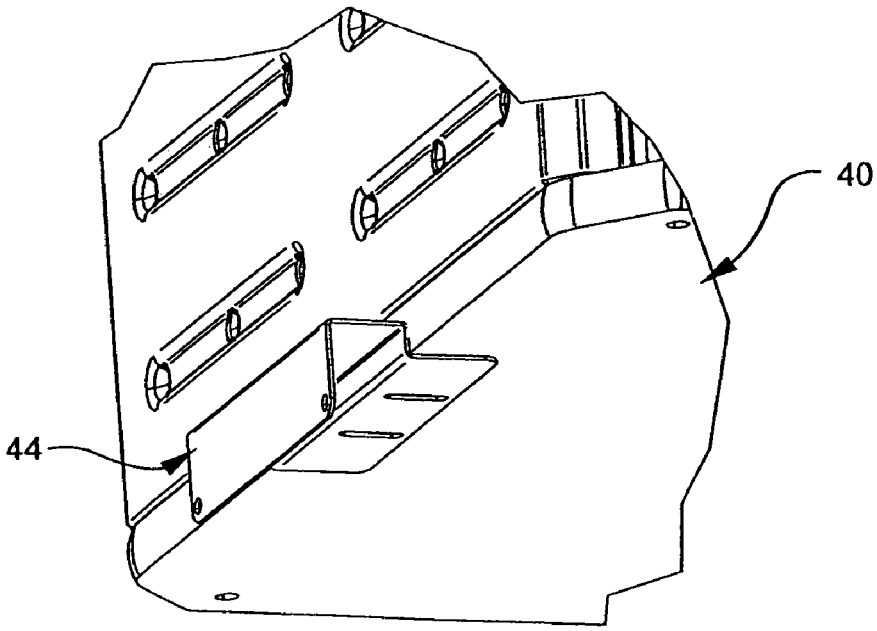
Figure 29:
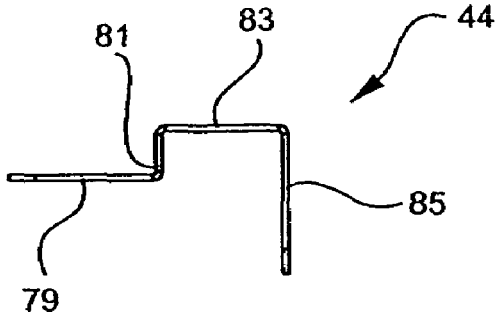
FIGS. 29, 30, and 31 respectively are side elevational, bottom plan and front plan views of the spacer installed at the bottom of a cabinet as shown in FIG. 28.
Figure 30:
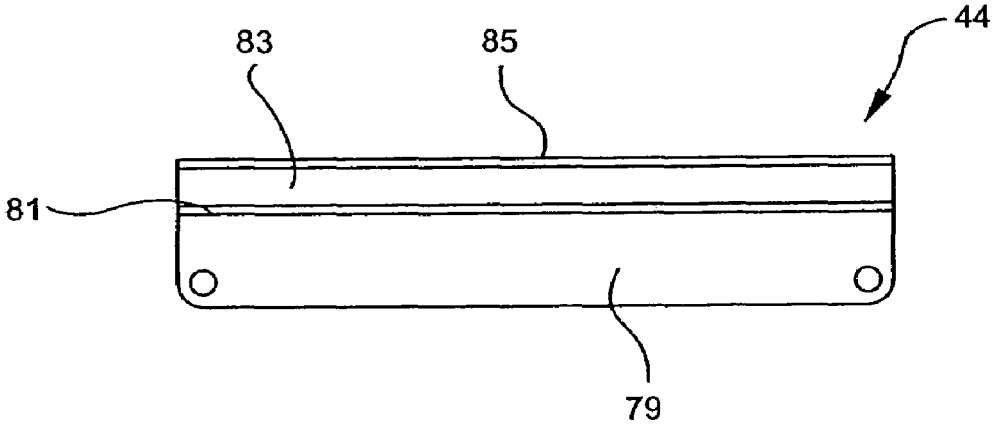
Figure 31:
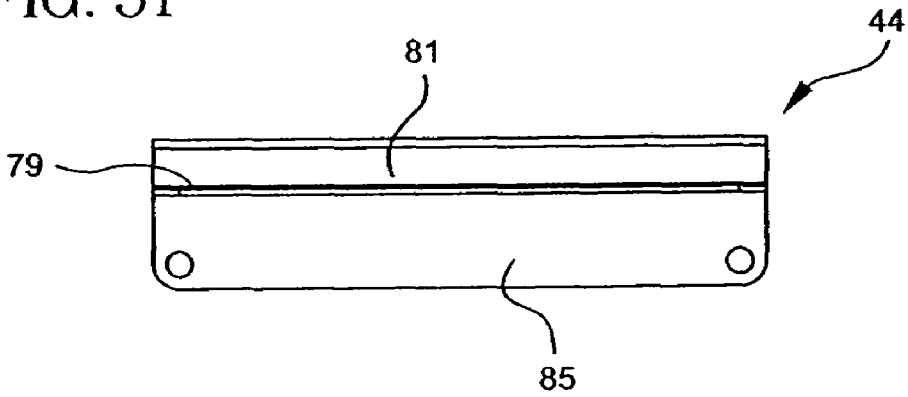

The grid-mounting brackets 36 can also be used to mount a cabinet 40 or other accessory in accordance with the present invention, as shown in FIG. 27. The cabinet 40 to be so mounted is first fitted with an upper supporting bracket 42 which comprises a depending lip 77 spaced from the back of the cabinet. A spacer 44, shown in FIGS. 28 to 31, is fitted near the bottom of the cabinet and is formed from sheet metal. When formed the spacer includes a flange 79, a first upstanding wall 81, a top wall 83, and a second depending wall 85 spaced from the first wall. The cabinet 40 can be mounted with the track by first installing a number of grid clips 34 therein as described above. The depending lip 77 of the supporting bracket 42 carried on the cabinet is the hooked over the arms 45 of the clip 34 as seen in FIG. 27. The spacer 44 fitted to the bottom of the cabinet 40 then spaces it from the mounting wall thereby to level the cabinet.

Figure 33:
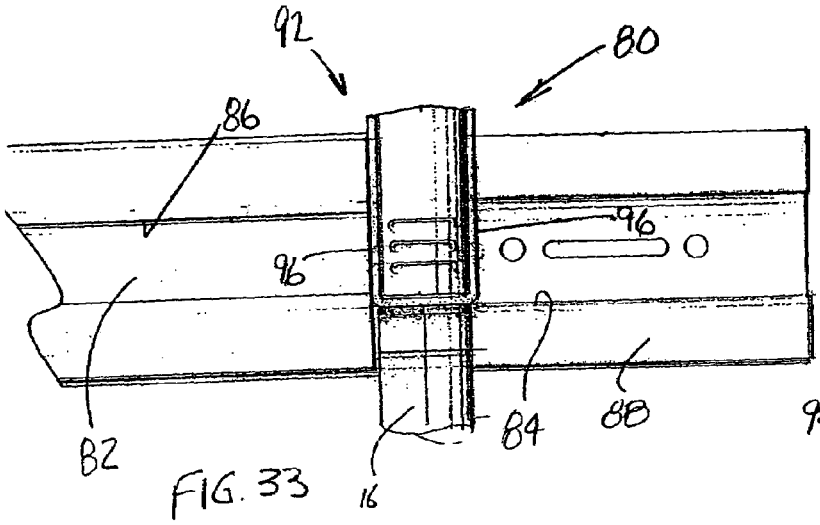
FIG. 33 is a front elevational view of the embodiment shown in FIG. 32.
Figure 32:
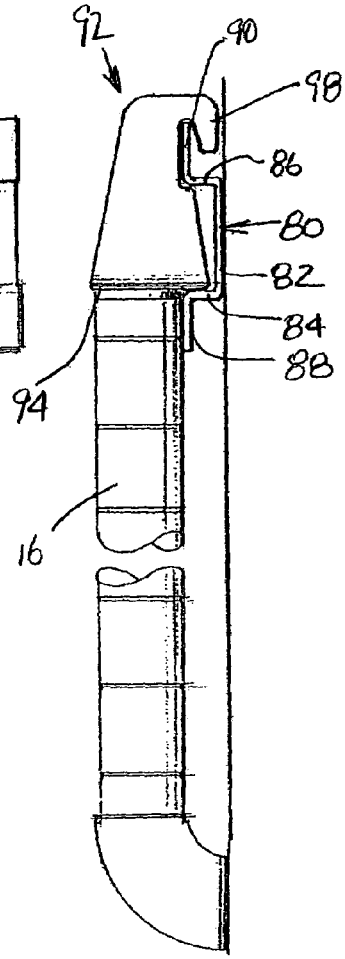
FIG. 32 is a side elevational view of an alternative embodiment of the present invention.

FIGS. 32 and 33 show another embodiment of the present invention, in which the horizontal track 80 may be in the form of that used in the InterMetro Industries commercial Starsys system. In particular, the track 80 is formed with a vertical web 82, a lower ledge 84 and an upper roof 86 projecting sidewardly from the web 82 away from a supporting wall, a lower flange 88 depending from the outer margin of the ledge 84, and an upper flange 90 projecting upwardly from the outer margin of the roof 86. In this embodiment the pilaster mounting bracket 92 is formed in a U-shape in front elevation (FIG. 33) by a floor 94 and opposed upwardly projecting arms 96. Structure, such as the frustoconical sleeve described above, for carrying a pilaster, is mounted on the floor 94 toward its front and the opposed arms 96 are formed with hooks 98.

As can be seen in FIG. 32, the mounting bracket is configured so that the rear margin of the floor can rest on the track ledge 84 while the hooks override the upper flange 90 of the track thereby to provide means for supporting the pilaster.

It will be appreciated that this alternative embodiment achieves many of the advantages of the embodiments described previously. For example, again the pilasters can be carried in the mounting bracket either to depend from it, or to project above it thereby to mount shelves above the track.

To summarize, the present invention described herein is a comprehensive wall-mounted shelving system, capable of supporting cabinets, grids, and a variety of shelving structures. The system is easily laid out and installed on a wall surface with minimal restriction due to wall-stud location or spacing. The system is minimally destructive of the supporting wall so that the grids, cabinets, and shelves can be readily rearranged with little or no damage or repair needed to the wall. The system is also easy to clean, holds loads common to commercial applications, and is cost-effective.

The invention has been described in connection with certain exemplary embodiments. However, it should be clear to those skilled in the art that various modifications in form and details may be made to those embodiments without departing from the spirit or scope of the invention as set forth in the claims below.

What is claimed is:

1. A mounting bracket for use with a system for mounting objects on a supporting wall in cooperation with a track mountable generally horizontally on the supporting wall, the track having an upper downwardly open channel and a ledge spaced below and in opposition to the channel, said mounting bracket comprising:

an upwardly projecting arm; and a floor joined to said arm to define an elbow;

said bracket being engagable with the track with an upper extreme of said arm received in the channel on the track and with said elbow supported on the ledge;

wherein objects can be carried by said bracket when engaged with the track and when the track is, in turn, mounted on the supporting wall, wherein said mounting bracket is configured to support a pilaster vertically, and further comprises pilaster support means for supporting the pilaster when said bracket is engaged with the track, wherein said pilaster support means comprises means for exerting a force toward an axis of the pilaster when supported by said pilaster support means, wherein said force-exerting means comprises an inverted frustoconical collar carried on said floor of said mounting bracket to receive the pilaster.

2. The mounting bracket according to claim 1, wherein said arm and said floor of said bracket are joined to define an acute angle to form said elbow.

3. The mounting bracket according to claim 1, wherein said force-exerting means further comprises a sleeve having a frustoconical outer surface configured to mate with said frustoconical collar and an inner surface configured to mate with said pilaster; wherein when said mounting bracket is engaged with said track, said sleeve is mated with said pilaster, and said sleeve and said pilaster are received in said collar, downward loading of said pilaster creates a wedge-like interaction between said collar and said sleeve to exert a force on said pilaster toward the axis thereof.

4. The mounting bracket according to claim 1, wherein said inverted frustoconical collar comprises a collar having a wedge surface inclined upwardly, outwardly away from an axis of said collar, carried on said floor of said mounting bracket to receive the pilaster.

5. The mounting bracket according to claim 4, wherein said force-exerting means further comprises a wedge having a first surface configured to mate with the wedge surface of said collar, and a second surface configured to mate with said pilaster; wherein when said mounting bracket is engaged with said track, said wedge is mated with said pilaster, and said sleeve and said pilaster are received in said collar, downward loading of said pilaster creates a wedge-like interaction between said collar and said wedge to exert a force on said pilaster toward the axis thereof.

* * * * *